US008348187B2

(12) United States Patent
Kozyuk

(10) Patent No.: US 8,348,187 B2
(45) Date of Patent: Jan. 8, 2013

(54) SYSTEM AND PROCESS FOR REDUCING SOLID PARTICLE SIZE

(75) Inventor: Oleg V. Kozyuk, North Ridgeville, OH (US)

(73) Assignee: Cavitech Holdings, LLC, Independence, OH (US)

( * ) Notice: Subject to any disclaimer, the term of this patent is extended or adjusted under 35 U.S.C. 154(b) by 0 days.

(21) Appl. No.: 12/754,133

(22) Filed: Apr. 5, 2010

(65) Prior Publication Data

US 2010/0252660 A1 Oct. 7, 2010

Related U.S. Application Data

(60) Provisional application No. 61/166,871, filed on Apr. 6, 2009.

(51) Int. Cl.
*B02C 19/18* (2006.01)

(52) U.S. Cl. ..... 241/39; 241/79; 241/152.2

(58) Field of Classification Search ..... 241/1, 301, 241/5, 39, 40, 152.2, 79
See application file for complete search history.

(56) References Cited

U.S. PATENT DOCUMENTS 3,852,191 A * 12/1974 Zucker et al. ..... 210/774
4,156,593 A * 5/1979 Tarpley, Jr. ..... 44/624
4,629,135 A * 12/1986 Bodine ..... 241/201
6,737,099 B2 5/2004 Guraya
6,824,086 B1 * 11/2004 Mazurkiewicz et al. ..... 241/5
2005/0136123 A1 6/2005 Kozyuk
2008/0193520 A1 8/2008 Moschwitzer et al.
2008/0197218 A1 * 8/2008 Ishigaki et al. ..... 241/5

FOREIGN PATENT DOCUMENTS

JP 4-108545 * 4/1992
WO 2006105401 A2 10/2006

OTHER PUBLICATIONS

International Search Report and Written Opinion for PCT/US2010/030024, dated Jun. 3, 2010.

* cited by examiner

*Primary Examiner* — Mark Rosenbaum
(74) *Attorney, Agent, or Firm* — Benesch Friedlander Coplan & Aronoff LLP

(57) ABSTRACT

Various embodiments of a system and process for reducing the size of solid particles are disclosed. In one embodiment the system includes a cavitation processor and a comminution processor in physical communication with one another to reduce the size of solid particles. In another embodiment, a process for reducing the size of solid particles includes passing the solid particles sequentially through a cavitation processor and a comminution processor which are in physical communication with one another. Examples of solid particles which may be used in the system and process herein, include pharmaceuticals, foods, inks and paints.

11 Claims, 3 Drawing Sheets

SYSTEM AND PROCESS FOR REDUCING SOLID PARTICLE SIZE

CROSS REFERENCE TO RELATED APPLICATIONS

The present application claims priority to U.S. Provisional Patent Application No. 61/166,871 entitled "System and Process for Reducing Solid Particle Size" which was filed on Apr. 6, 2009.

BACKGROUND

The present application relates to systems and processes for preparing a dispersion of solid particles having increased purity and reduced particle size.

Wet grinding takes place primarily in agitated grinding media mills. Agitated grinding media mills move grinding media relative to each other by a fast rotating agitator in a liquid phase. The particles are comminuted primarily between the colliding grinding media. Traditionally, wet grinding is used with high-energy agitated grinding media mills for different applications to generate micrometer-sized particles and nanoparticles.

The mechanical reduction of a product into micrometer-sized particles is determined by the product's mechanical material properties. The particle strength and the mass-specific comminution energy of a product increase strongly with decreasing particle size.

The contamination of the product by wear of the grinding media and/or the grinding chamber is common. (See CLEMENT, M., 1986. Verschleiss bei der Zerkleinerung. In: Uetz, H. (ed.) *Abrasion and Erosion*. München and Wien, Carl Hanser Verlag, pp. 468-533.). In general, the grinding media produce most of the wear and primarily consist of different materials in comparison to the product or material to be ground. Usually metallic, silicate or ceramic materials, such as chrome steel, glass, alumina or zirconium oxide, are used as grinding media. The contaminations by wear of these materials impair products that have high purity requirements, such as for example pharmaceuticals, food, inks and paints.

Some efforts have been made to minimize contamination of the material to be ground. For example, some have attempted to use small plastic grinding media to decrease wear of grinding media and mill parts to reduce the contaminations. E. Merisko-Liversidge and co-workers employed such techniques to successfully reduce the contaminations from 1000 ppm by mill parts made from chrome steel to 10 ppm by grinding media of plastic. (MERISKO-LIVERSIDGE, E.; LIVERSIDGE, G. G.; COOPER, E. R. 2003. Nanosizing: a formulation approach for poorly-water-soluble compounds. *European Journal of Pharmaceutical Sciences* 18, pp. 113-120.).

Of course, another possible technique for decreasing the amount of contaminations would be to decrease the processing time of substances ground in the milling chamber. Merely decreasing the processing time, however, will generally cause an increase in the resulting particle size.

SUMMARY

The various embodiments described herein provide for systems and processes in which fine particles can be prepared in a reduced processing time while also increasing the purity of the reduced size particles.

In one embodiment, a system for reducing the size of solid particles includes a cavitation processor and a comminution processor in physical communication with one another. In another embodiment the system includes a conduit disposed between the cavitation processor and the comminution processor. The conduit can be disposed between an outlet of the cavitation processor and the inlet of the comminution processor to transport the solid particles from the cavitation processor to the comminution processor. In an alternative embodiment the conduit can be disposed between an outlet of the comminution processor and the inlet of the cavitation processor to transport the solid particles from the comminution processor to the cavitation processor. The system can optionally include a feed particle source, a liquid media source, and a mixer which produces a slurry containing feed particles to be fed to the cavitation processor and the comminution processor.

In another embodiment, a process is provided for producing solid particles having reduced particle size. The process comprises the step of contacting the solid feed particles with a liquid medium to create a slurry and inducing compressive forces and shearing forces onto the particles to produce a slurry of product particles which are smaller than the feed particles. In one embodiment the process comprises passing the slurry through a cavitation processor followed by passing the slurry through a comminuting processor. In another embodiment the process comprising passing the slurry through a comminuting processor followed by passing the slurry through a cavitation processor. In another embodiment, the process comprises the step of passing the slurry sequentially through each of a comminuting processor and a cavitation processor at least two times. In yet another embodiment, the process further comprises separating the product particles from the liquid medium of the slurry to recover the smaller product particles.

BRIEF DESCRIPTION OF THE DRAWINGS

These and other features, aspects, and advantages of the present invention will become better understood with regard to the following description, appended claims, and accompanying drawings. The various embodiments of the present invention can be understood by the following drawings and figures. The components are not necessarily to scale.

DETAILED DESCRIPTION

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2nd. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components.

The present application describes systems and processes for preparing a dispersion of solid particles having reduced particle size and reduced contamination. Materials having low contamination ratios can be produced utilizing these systems and processes including pharmaceutical drugs, food, inks and paints, for example. Using the systems and processes described in the various embodiments of the application herein, fine particles can be prepared while contamination of the substances to be ground can be decreased. Surprisingly, it has been found that the processing time for reducing particle size, utilizing the various processes described herein, can be decreased up to about 50%, in another embodiment from about 10% to about 45%, and in another embodiment from about 25% to about 35%, relative to particles sizes of solid particles produced in processes involving either cavitation or comminution alone. The embodiments of the system and process herein produce synergistic results in significantly decreased particle size via low residence time and increased purity, whereas conventional processes require longer processing times which leads to higher product contamination.

Figure 1:
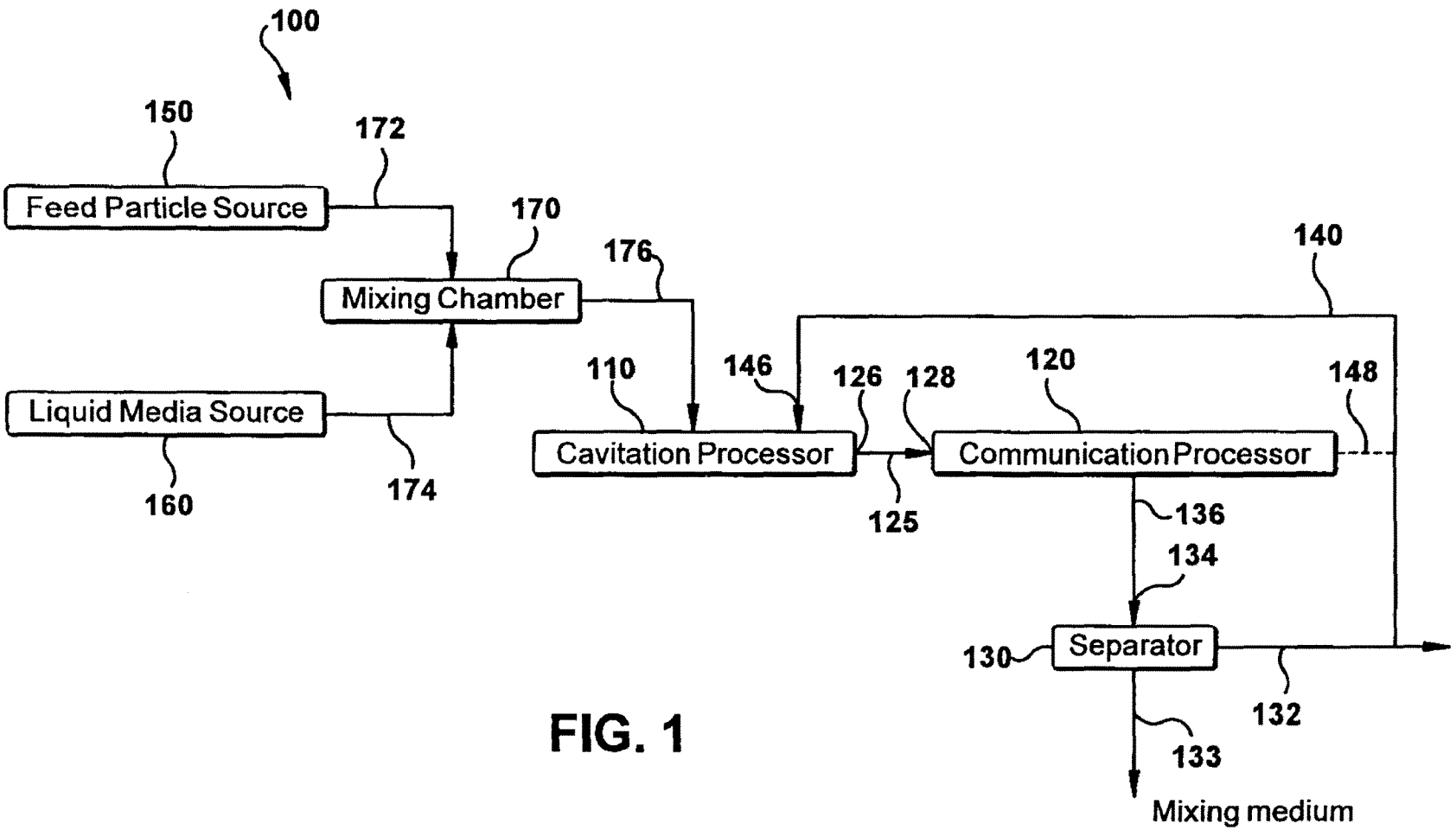
FIG. 1 is a schematic illustration of a system for reducing the size of solid particles comprising a cavitation processor and a comminution processor which allows flow of solid particles from the cavitation processor to the comminution processor, according to an embodiment of the present invention.

FIG. 1 is a schematic illustration of a system 100 for reducing the size of solid particles, according to an embodiment of the present invention. System 100 includes a cavitation processor 110 and a comminution processor 120 in physical communication with one another. In one embodiment, the cavitation processor 110 and the comminution processor 120 are in physical communication via conduit 125. The cavitation processor 110 imparts compressive stresses on hydrodynamic cavitation on the solid particles, as will be further described. The comminution processor 120 can include a milling processor containing milling media to impart a shear force on the solid particles.

Therefore in one embodiment a system for reducing the size of solid particles includes a cavitation processor 110, a comminution processor 120 in physical communication with the cavitation processor 110 arranged such that the solid particles are transported from the cavitation processor 110 to the comminution processor 120. As shown, for example, conduit 125 is disposed between a cavitation processor outlet 126 and a comminution processor inlet 128. System 100 can optionally include a product conduit 132 which allows for the flow of particles having reduced size out of the system 100.

System 100 optionally includes a separator 130. Separator 130 removes the milling media that is used to shear the solid particles in the comminution processor 120. Although separator 130 is shown as a separate unit, it may be encompassed by or integral with the comminution processor 120. If separator 130 is a separate unit as shown in FIG. 1, the system optionally includes conduit 134 which extends between the comminution processor outlet 136 and the separator 130.

In another embodiment, system 100 further includes a recirculation conduit 140 which allows for repetitive and continuous flow of the solid particles through the cavitation processor 110 and the communition processor 120. Recirculation conduit 140 is disposed between the cavitation processor 110 and the comminution processor 120. If the system includes separator 130 as a separate unit as shown, for example, recirculation conduit 140 can be disposed between separator 130 and cavitation processor 110, for example, from the separator outlet 142 and the cavitation processor inlet 146. In an alternative embodiment, the recirculation conduit can extend from the comminution processor 120 to the cavitation processor 110. The recirculation conduit 140 allows for the flow of particles through the cavitation processor 110 and the communition processor 120 at least two times.

Still referring to FIG. 1, in another embodiment of the invention, system 100 optionally includes a feed particle source 150, a liquid medium source 160 and a mix chamber 170. Solid particle source 150 and liquid medium source 160 are in physical communication with a mix chamber 170 via conduits 172 and 174, respectively, such that solid particles stored within particle container 150 and liquid medium stored in liquid medium container 160 can come into contact with one another in mix chamber 170 to produce a slurry. The slurry containing the feed particles therefore flows from the mixing chamber 170 through conduit 176 to the cavitation processor 110 and the comminution processor 120.

Figure 2:
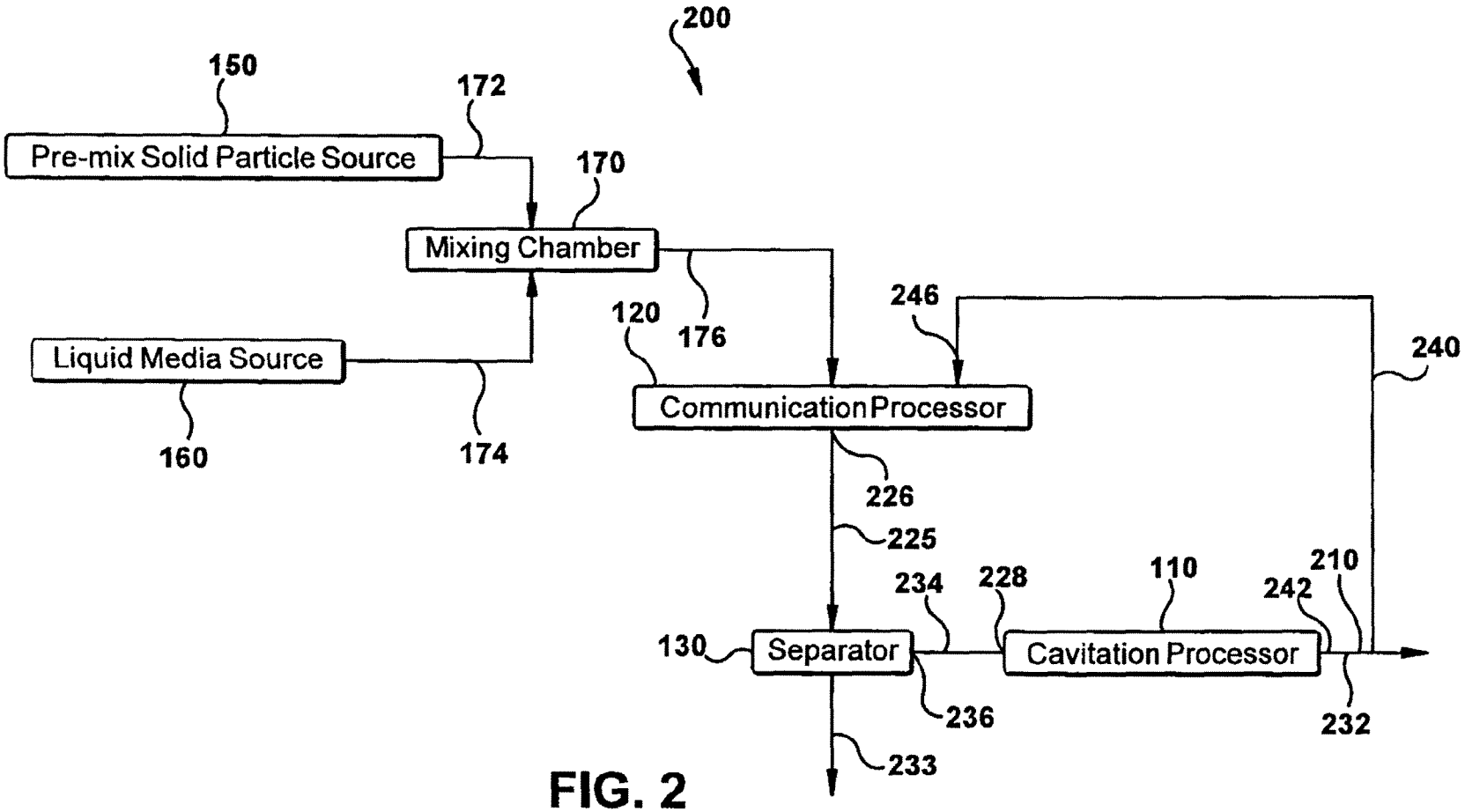
FIG. 2 is a schematic illustration of a system for reducing the size of solid particles comprising a communition processor and a cavitation processor which allows flow of solid particles from the comminution processor to the cavitation processor, according to an embodiment of the present invention.

FIG. 2 is a schematic illustration of a system 200 for reducing the size of solid particles, in accordance with another embodiment of the present invention. System 200 includes a comminution processor 120 and a cavitation processor 110 in physical communication with one another. Optionally, conduit 225 is disposed between a comminution processor outlet 226 and a cavitation processor inlet 228 to transport the solid particles from the comminution processor 120 to the cavitation processor 110. System 200 optionally includes a product conduit 232 which allows for the flow of particles having reduced size out of the system 200.

System 200 optionally includes a separator 130. Separator 130 removes the milling media from the slurry containing solid particles and which flows through the comminution processor 120 before the slurry enters the cavitation processor 110. Although separator 130 is shown as a separate unit, it may be encompassed by or integral with the comminution processor 120. If a separate unit as shown in FIG. 2, the system optionally includes conduit 234 which extends between the separator outlet 236 and the cavitation processor inlet 228.

In another embodiment, system 200 further includes a recirculation conduit 240 which allows for repetitive and continuous flow of the solid particles through the comminution processor 120 and the cavitation processor 110. Recirculation conduit 240 is shown disposed between cavitation processor 110 and the comminution processor 120, for example, from the cavitation processor outlet 242 and the comminution processor inlet 246.

As described above with respect to FIG. 1, system 200 of FIG. 2 optionally includes a solid particle source 150, a liquid medium source 160 and a mix chamber 170. Solid particle source 150 and liquid medium source 160 are in physical communication with a mix chamber 170 via conduits 172 and 174, respectively, such that solid particles stored within particle container 150 and liquid medium stored in liquid medium container 160 can come into contact with one another in mix chamber 170 to produce a slurry. The slurry containing the feed particles therefore flows from the mixing chamber 170 through conduit 176 to the cavitation processor 110 and the comminution processor 120.

The slurry flows in series through the communition processor 110 and the cavitation processor 120 in either order. That is, in the example embodiment shown in FIG. 1 the slurry flows first through cavitation processor 110 and then subsequently flows through comminution processor 120 to produce a dispersion of solid particles having an average particle size which is less than that of the feed particles. In the system is arranged as in FIG. 2 such that the slurry flows first through comminution processor 120 and then subsequently flows through cavitation processor 110 to produce a dispersion of solid particles having an average particle size which is less than that of the feed particles.

In another embodiment the system of FIGS. 1 and 2 are continuous milling systems in which the slurry is passed through the comminution processor and the cavitation processor at least two times each. Therefore, in another embodiment of the present invention, the slurry passes through the comminution processor and then passes through the cavitation processor and then the slurry is routed back through the comminution processor and flows through the inlet of the comminution processor through the outlet and to the inlet of the cavitation processor and out the cavitation processor to produce a dispersion having reduced particle size. The number iterations at which the slurry is passed through each of the comminution and cavitation processors depends on the desired particle size. It can also be appreciated that the slurry can pass through the comminution processor prior to the cavitation processor and the order is not important.

In any of the embodiments described above, the system 100 (FIG. 1), 200 (FIG. 2) optionally includes a product separator (not shown) to recover the product particles from the slurry. Alternatively, if the separator 133 (FIG. 1) that separates milling media from the slurry is integral with the comminution processor 120, then separator 133 of FIG. 1 can represent the product separator that recovers the solid product particles from the liquid, where the solid product particles are reduced in size from the solid feed particles. The size of the product particles can vary based on several variables, not limited to, the type of solid material, the milling media, the time processed. For example the product feed material can be less than 1 micron, and in another embodiment less than 0.5 micron, and in yet another embodiment less than 0.3 micron. Product separators can include, but are not limited to, filtration devices, centrifuge devices, and several other devices and processes utilizing these devices as known by those of ordinary skill in the art.

In addition, any of the embodiments described above, the system can further include a pump that provides energy to circulate the slurry. The pump can be integral with the cavitation processor 110 and/or comminution processor 120, or alternatively, the pump may be a separate unit. The pressure created in the cavitation processor 110 can be as high as about 40,000 psi, in another embodiment, pressure can be up to 30,000 psi, and in another embodiment range from 1,000 psi to 2,000 psi.

Materials which can be used herein include, but are not limited to, a non-steroidal anti-inflammatory drug and an excipient. An example of a suitable non-steroidal anti-inflammatory drug is selected from naproxen and pharmaceutically acceptable salts of naproxen. The excipient can include, but is not limited to, polymers, amino acids, wetting agents, sugars, preservatives, pegylated excipients, toxicity agents, and mixtures thereof. Sugars can include, but are not limited to, microcrystalline cellulose, hydroxyalkyl cellulose having from one to six carbon atoms ($C_1$-$C_6$), for example hydroxypropyl cellulose, and mixtures thereof.

Milling media materials that can be used in comminution device 120 include, but are not limited to, Zirconium Oxide ($ZrO_2$), Yttrium Oxide ($Y_2O_3$), steel, glass, sand, ceramics, polymers and mixtures thereof.

Figure 3:
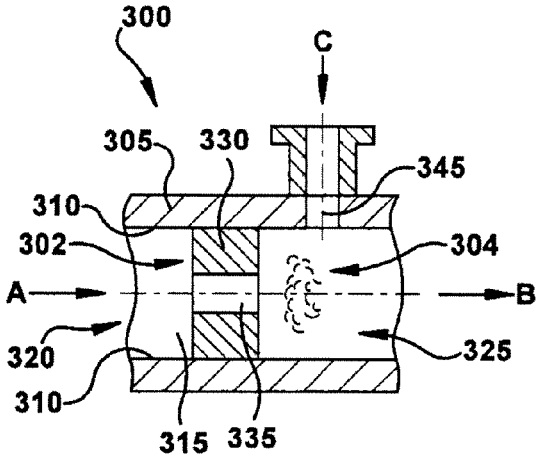
FIG. 3 is a cross-sectional view of a cavitation processor comprising an orifice-type cavitation generator, according to an embodiment of the present invention.

FIG. 3 illustrates a cross-sectional view of one embodiment of a cavitation processor 300 that can be used in the systems 100 (FIGS. 1) and 200 (FIG. 2) described above. The cavitation processor 300 is essentially an orifice-type hydrodynamic cavitation processor. The cavitation processor 300 includes a cavitation generator 302 that generates high shear forces and/or hydrodynamic cavitation in a cavitation zone 304 downstream of the cavitation generator. The cavitation processor 300 includes a wall 305 having an inner surface 310 that defines a flow-through channel or chamber 315. The flow-through channel 315 can further include an inlet 320 through which a fluid stream is introduced into the cavitation processor 300 along a flow path represented by arrow A and an outlet 325 through which the resultant fluid product exits from the cavitation processor 300 along a flow path represented by arrow B. The cavitation generator that can include a plate 330 having an orifice 335 disposed therein to produce a local constriction of flow. It will be appreciated that the plate can be embodied in the shape of a disk when the flow-through channel 315 has a circular cross-section, for example, or each plate can be embodied in a variety of shapes and configurations that matches or corresponds to the cross-section of the flow-through channel 315. To vary the degree and character of the cavitation field generated downstream from the plate 330, the orifice 335 can be embodied in a variety of different shapes and configurations. It will be appreciated that the orifice 335 can be configured in the shape of a Venturi tube, nozzle, orifice of any desired shape, or slot. Further, it will be appreciated that the orifice 335 can be embodied in other shapes and configurations. Accordingly, the orifice 335 disposed in the plate 330 can be configured to generate high shear forces and/or hydrodynamic cavitation in cavitation zone 340 downstream from the orifice 335. With further reference to FIG. 3, the flow-through channel 315 can optionally include a port 345 for introducing a second fluid stream into the flow-through channel 315 along a path represented by arrow C. For example, port 345 can be disposed in the wall 305 downstream from the plate 330 to permit the introduction of the second fluid stream into the cavitation zone 304. It will be appreciated that two or more ports can be provided in the wall 305 to introduce multiple fluid streams into the cavitation zone 304.

Figure 4:
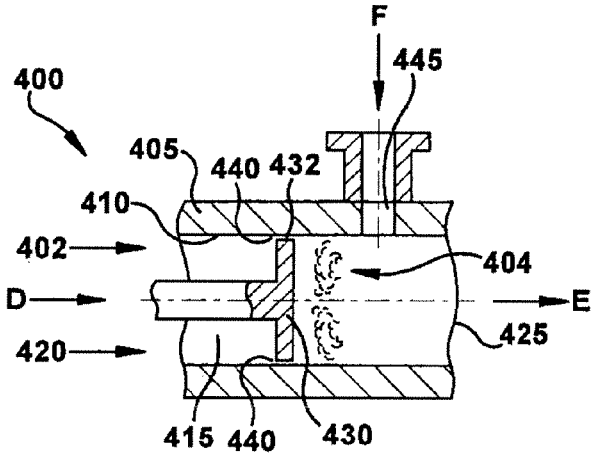
FIG. 4 is a cross-sectional view of a cavitation processor comprising a baffle-type cavitation generator, according to an embodiment of the present invention.

FIG. 4 illustrates a cross-sectional of a cavitation processor 400 that can be used in systems 100 and 200, in accordance with an embodiment of the present invention. The cavitation processor 400 is essentially a baffle-type hydrodynamic cavitation processor. The cavitation processor 400 includes a cavitation generator 402 that generates high shear forces and/or hydrodynamic cavitation in a cavitation zone 404 downstream of the cavitation generator. The cavitation processor 400 includes a wall 405 having an inner surface 410 that defines a flow-through channel or chamber 415. The flow-through channel 415 can further include an inlet 420 configured to introduce a fluid stream into the cavitation processor 400 along a path represented by arrow D and an outlet 425 configured to exit the resultant fluid product from the cavitation processor 400 along a path represented by arrow E.

The cavitation processor 400 can include a cavitation generator, such as a disc-shaped baffle 430. The baffle 430 produces annular flow of fluid within the cavitation processor 400. To vary the degree and character of the cavitation fields generated downstream from the baffle 430, the baffle 430 can be embodied in a variety of different shapes and configurations. It will be appreciated that the baffle 430 can be embodied in alternative shapes and configurations. In this embodiment, the baffle 430 can be configured to generate hydrodynamic cavitation in a cavitation zone 404 downstream from the baffle 430 positioned to create a local constriction 440 of fluid flow. For example, the local constriction 440 can be an area defined between the inner surface 410 of the wall 405 and an outer surface 432 of the baffle 430.

With further reference to FIG. 4, the flow-through channel 415 can further include a port 445 for introducing a second fluid stream into the flow-through channel 415 along a path represented by arrow F. In one embodiment, the port 445 can be disposed in the wall 405 downstream from the local constriction 440 of flow to permit the introduction of the second fluid stream into the mixing zone 435. It will be appreciated that any number of ports can be provided in the wall 405 to introduce multiple fluid streams into the cavitation zone 404.

Figure 5:
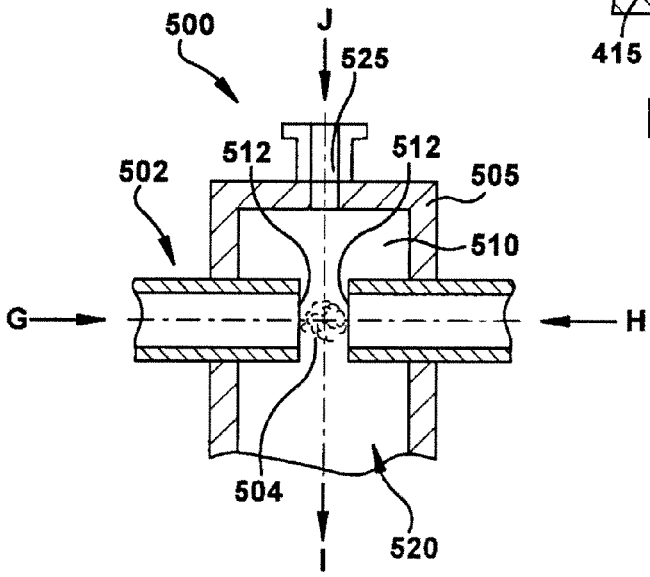
FIG. 5 is a cross-sectional view of a cavitation processor comprising an impingement-type cavitation generator, according to an embodiment of the present invention.

FIG. 5 illustrates a cross-sectional view of a cavitation processor 500, according to another embodiment of the present invention. The cavitation processor 500 includes a fluid impingement cavitation generator. The cavitation processor 500 includes a cavitation generator 502 that generates high shear forces and/or hydrodynamic cavitation in a cavitation zone 504 downstream of the cavitation generator. The cavitation processor 500 includes a housing 505 defining a passageway 510 configured to permit introduction of at least two fluid streams, represented by arrows G and H. Fluid streams G and H flow through openings 512 for impingement mixing thereof. The impingement of the two fluid streams can generate impact forces in cavitation zone 504 in the passageway 510. The cavitation processor 500 can further include an outlet 520 configured to exit the resultant fluid product from the cavitation processor 500 along a path represented by arrow I. In another embodiment, the housing 505 can further include a port 525 for introducing a third fluid stream into the passageway 510 along a path represented by arrow J. In one embodiment, port 525 can be disposed in the housing 505 to permit the introduction of the second fluid stream into the cavitation zone 504. It will be appreciated that two or more ports can be provided in the wall 505 to introduce multiple fluid streams into the cavitation zone 504.

In one embodiment the comminution processor 110 comprises a wet grinding mill and milling media, for example. A suitable wet grinding mill is available as model DYNO®-MILL KDL of Glen Mills Inc., Clifton, N.J., USA.

Milling media, for example in the shape of beads, can be made of one or more materials which include but are not limited to, polymers, glass, steel, tungsten carbide, and ceramics such as aluminum oxide and zirconium oxide, for example.

EXAMPLES

The following examples are given for the purpose of illustrating the described systems and processes and should not be construed as limitations on the scope or spirit thereof.

Control Example 1

In Control Example 1 the initial Noproxen composition particles, or feed particles, in the form of micronized powders were measured and ranged in size from 0.8 micron to 70 microns.

Examples 1-6

In Examples 1 through 6, a slurry containing solid feed particles was run through different types of cavitation processors at a specified pressure and time period to reduce the particle sizes. In each example the process was repeated using one of four different size particles, D10, D43, D50 and D90, as the feed particles for the slurry.

Each slurry with feed particles of varying size was made by combining feed particles of Naproxen composition in the form of micronized powder with water. The slurry composition contained, 3.0% Naproxen non-steroidal anti-inflammatory drug (NSAID), 0.5% hydroxypropyl-cellulose (HPC-SL) surface modifier, 0.02% sodium lauryl sulfate (SLS) detergent and 96.48% water.

Each slurry with feed particles of varying size was recirculated through the three different type cavitation processors (CM22, CP300 and LE300) and at a different pressure and at three different time periods to produce a slurry containing product particles which were smaller than the feed particles. The average particle sizes of the Naproxen product particles were measured at time intervals of 30, 60 and 90 minutes using microscopic examination and light scattering technique (Malvern Mastersizer).

Table I below shows the results of Examples 1-6, namely the average particle sizes of the product particles run through the various cavitation processes for different time periods. Pressure in the cavitation device ranged from approximately 1,000 psi to approximately 25,000 psi and the time varied from 25 minutes to 240 minutes. In all examples, the particle size was greater than 1 micron.

Examples 7-9

In Examples 7-9, a slurry containing feed particles was run through a comminution processor via a continuous milling process using Naproxen in a DynoMill KDL A (0.6 liters) at a specified pressure and time period to reduce the particle sizes. In each example the process was repeated using one of three different size particles, D43, D50 and D90, as the feed particles for the slurry.

Each slurry with feed particles of varying size (particle size ranged from 0.8 micron to 70 microns) was made by combining feed particles of Naproxen composition in the form of micronized powder with water. The slurry composition contained 4.6% Naproxen non-steroidal anti-inflammatory drug (NSAID), 2.8% hydroxypropyl-cellulose (HPC-SL) surface modifier, 0.005% sodium lauryl sulfate (SLS) detergent and 92.6% water.

A slurry in the amount of 324.2 grams was combined with 2700 grams of 0.8-1.0 mm Zirconium Oxide (ZrO2) grinding beads and was recirculated through a 0.6 liter DynoMill at 3000 rpm by a plunger pump from a CP300 system. The grinding media was contained within the milling chamber. The Naproxen particle size was measured at time intervals of 30, 60 and 90 minutes using a light scattering technique (Malvern Mastersizer). The results are listed below in Table 1. Examples 7-9 show that particles sizes were greater than 1 micron if the time period for processing was 30 minutes or less. Also, it was observed that the particles became a darker color as the time period increased. The change in color was due to the contamination of the product by wear of the grinding media.

Examples 10 and 11

In Examples 10 and 11, a slurry containing feed particles was run through both a cavitation processor and a comminution processor sequentially. Each slurry of different average size of feed particles was run continuously through a CP300 cavitation processor at 2000 psi pressure and a DynoMill KDL A (0.6 liters) comminution processor at a specified time period to reduce the particle sizes. In each example the process was repeated using one of three different size particles, D43, D50 and D90, as the feed particles for the slurry.

Each slurry with feed particles of varying size (particle size ranged from 0.8 micron to 70 microns) was made by combining feed particles of Naproxen composition in the form of micronized powder with water. The slurry composition contained 4.6% Naproxen non-steroidal anti-inflammatory drug (NSAID), 2.8% hydroxypropyl-cellulose (HPC-SL) surface modifier, 0.005% sodium lauryl sulfate (SLS) detergent and 92.6% water.

A slurry in the amount of 324.2 grams was combined with 2700 grams of 0.8-1.0 mm Zirconium Oxide (ZrO2) grinding beads and the slurry was recirculated through a 0.6 liter DynoMill at 3000 rpm and cavitation processor CP300 at 2000 psi pressure The grinding media was contained within the milling chamber of the comminution processor. The Naproxen particle size was measured at time intervals of 30, 60 and 90 minutes using a light scattering technique (Malvern Mastersizer). The results are listed below in Table I.

TABLE I

| | | | | Average Particle Size | | | |
|---|---|---|---|---|---|---|---|
| Example | Processor | Pressure (PSI) | Time (min) | D43 (μm) | D10 (μm) | D50 (μm) | D90 (μm) |
| Control 1 | None | — | — | 10.43 | 3.07 | 8.27 | 20.28 |
| Ex. 1 | CM22 | 1,000 | 90 | 5.91 | 2.17 | 5.06 | 10.77 |
| Ex. 2 | CM22 | 1,000 | 210 | 5.34 | 2 25 | 4.54 | 9.14 |
| Ex. 3 | CP300 | 2,500 | 44 | 5.66 | 2.16 | 4.73 | 10.37 |
| Ex. 4 | CP300 | 25,000 | 25 | 2.83 | 1.19 | 2.41 | 5.03 |
| Ex. 5 | LE300 | 9,000 | 120 | 2.76 | 1.18 | 2.41 | 4.83 |
| Ex. 6 | LE300 | 9,000 | 240 | 2.31 | 1.10 | 2.10 | 3.85 |
| Ex. 7 | Dyno-Mill KDL A | — | 30 | 1.21 | — | 0.31 | 1.13 |
| Ex. 8 | Dyno-Mill KDL A | — | 60 | 0.37 | — | 0.23 | 0.59 |
| Ex. 9 | Dyno-Mill KDL A | — | 90 | 0.26 | — | 0.22 | 0.49 |
| Ex. 10 | CP300 and Dyno-Mill KDL | 2,000 | 30 | 0.48 | — | 0.30 | 0.96 |
| Ex. 11 | CP300 and Dyno-Mill KDL | 2,000 | 60 | 0.26 | — | 0.22 | 0.49 |

An examination of the data presented in Table I, reveals that by circulating each slurry sequentially through both the cavitation processor and the comminuting processor, the same particle size can be achieved while decreasing the processing time by 33%. This also produces a higher purity product. In Example 10, the average particle sizes produced was less than 1 micron in all cases after 30 minutes of processing. In Example 11 the average particle size produced was less than 0.5 micron after 60 minutes of processing. That is, average particle sizes of 0.22, 0.26 and 0.49 which employed both the CP300 and the Dyno-Mill KDL could be achieved after 60 minutes of processing, whereas of the same average size of the product particle of Example could only be achieved after 90 minutes of processing using the Dyno-Mill KDL comminution processor. Processing using only the cavitation processor CP300 could not achieve such a low average particle size even at time periods of 90 minutes.

While the present application illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

What is claimed is:

1. A system for reducing the size of solid particles, the system comprising: a cavitation processor comprising a cavitation generator including a plate having an orifice therethrough; and a comminution processor, wherein the comminution processor is in physical communication with the cavitation processor.

2. The system of claim 1, wherein: the cavitation processor comprises a first inlet disposed upstream of the cavitation generator, a second inlet disposed downstream of the cavitation generator, and an outlet; the comminution processor comprises an inlet and an outlet; and wherein the cavitation processor outlet is in physical communication with the comminution processor inlet to transport the solid particles from the cavitation processor to the comminution processor.

3. The system of claim 1, wherein: the cavitation processor comprises an inlet and an outlet; the comminution processor comprises an inlet and an outlet; and wherein the comminution processor outlet is in physical communication with the cavitation processor inlet to transport the solid particles from the comminution processor to the cavitation processor.

4. The system of claim 1, further comprising a recirculation conduit disposed between the comminution processor and the cavitation processor.

5. The system of a claim 1, further comprising a solid particle source and a liquid medium source.

6. The system of claim 5, further comprising: a mixing chamber in communication with the solid particle source and the liquid media source.

7. The system of claim 1, further comprises a separator.

8. The system of claim 7, wherein the separator is downstream from at least one of the cavitation processor and the comminution processor.

9. The system of claim 7, wherein the separator functions to recover solid product particles from a liquid medium.

10. The system of claim 1, wherein the cavitation processor comprises a cavitation generator and a cavitation zone downstream of the cavitation generator.

11. The system of claim 1, wherein the solid particles comprise a pharmaceutical drug.

* * * * *